US010850426B2

(12) United States Patent
Toncelli et al.

(10) Patent No.: US 10,850,426 B2
(45) Date of Patent: Dec. 1, 2020

(54) DISPENSER FOR MIXES

(71) Applicant: BRETON SPA, Castello di Godego (IT)

(72) Inventors: Luca Toncelli, Bassano del Grappa (IT); Angelo Luison, Castello di Godego (IT); Giuliano Luison, Castello di Godego (IT)

(73) Assignee: BRETON SPA, Castello di Godego (IT)

( * ) Notice: Subject to any disclaimer, the term of this patent is extended or adjusted under 35 U.S.C. 154(b) by 45 days.

(21) Appl. No.: 16/067,714

(22) PCT Filed: Dec. 28, 2016

(86) PCT No.: PCT/IB2016/058051
§ 371 (c)(1),
(2) Date: Jul. 2, 2018

(87) PCT Pub. No.: WO2017/118901
PCT Pub. Date: Jul. 13, 2017

(65) Prior Publication Data

US 2019/0001524 A1 Jan. 3, 2019

(30) Foreign Application Priority Data

Jan. 4, 2016 (IT) ..... 102016000000154

(51) Int. Cl.
*B28B 13/02* (2006.01)

(52) U.S. Cl.
CPC ..... *B28B 13/0215* (2013.01)

(58) Field of Classification Search
CPC ..... B65G 17/062; B65G 17/064; B65H 2404/271; B02C 7/04; B07B 1/4609;
(Continued)

(56) References Cited

U.S. PATENT DOCUMENTS 5,558,208 A * 9/1996 Kucharski ..... B65G 17/064 198/848
7,140,869 B2 11/2006 Toncelli
(Continued)

FOREIGN PATENT DOCUMENTS

EP 0228725 A1 * 7/1987 ..... D02G 3/12
WO 2006045728 A1 5/2006

OTHER PUBLICATIONS

PCT International Search Report and Written Opinion dated Apr. 11, 2017 for Intl. App. No. PCT/IB2016/058051, from which the instant application is based, 10 pgs.

*Primary Examiner* — Jessica Cahill
*Assistant Examiner* — Christopher M Afful
(74) *Attorney, Agent, or Firm* — Fredrikson & Byron, P.A.

(57) ABSTRACT

A mix dispenser (14) comprises a hopper (24) with a top opening (26) for filling the hopper with a predetermined amount of mix and a bottom opening (28). The dispenser comprises a conveyor (30) which forms the bottom of said hopper (24) and is designed to extract the mix from the hopper (24) and convey it towards an end from where it falls into a mould. The dispenser is characterized in that said conveyor (30) comprises a supporting meshwork (32) made of a material resistant to the vapours of solvents such as styrene and operated by an electric motor (34). Furthermore a plant comprising such as dispenser is also described.

17 Claims, 5 Drawing Sheets

(58) Field of Classification Search
CPC ... B07B 1/4618; B07B 1/4627; B07B 1/4636; B07B 1/4645; B07B 1/4654; B07B 1/4663; B07B 1/4672; B07B 1/4681; B07B 1/469; B28B 13/0215
See application file for complete search history.

(56) References Cited

U.S. PATENT DOCUMENTS

| | | | | |
|---|---|---|---|---|
| 7,837,454 | B2 | 11/2010 | Toncelli | |
| 9,174,358 | B2 | 11/2015 | Toncelli | |
| 9,579,821 | B2 | 2/2017 | Toncelli | |
| 2003/0196876 | A1* | 10/2003 | Weiser | B65G 17/086 198/853 |
| 2006/0163039 | A1* | 7/2006 | Marshall | B65G 15/54 198/778 |
| 2011/0318483 | A1* | 12/2011 | Toncelli | B28B 1/005 427/197 |
| 2014/0141961 | A1 | 5/2014 | Koszo et al. | |

* cited by examiner

DISPENSER FOR MIXES

RELATED APPLICATIONS

This application is a 35 U.S.C. 371 national stage filing from International Application No. PCT/IB2016/058051, filed Dec. 28, 2016, which claims priority to Italian Application No. 102016000000154, filed Jan. 4, 2016, the teachings of which are incorporated herein by reference.

The present invention relates to a dispenser for mixes.

More particularly, the present invention relates to a weight-controlled dispenser for mixes for the production of slabs or blocks of stone material.

This type of dispenser is used for example in plants where slabs or blocks are made using a method which is characterized by the so-called vacuum vibro-compression of mixes.

The mixes are obtained by mixing mainly stone or ceramic granules and binders which may be organic, such as synthetic resins, or inorganic, such as cement or ceramic binders.

In the case of slabs, the plants envisage the use of temporary supports for the mix with dimensions slightly greater than those of the finished slabs, whereby these dimensions may reach even high values, such as 3.6 m by 2.10 m, and with very small thicknesses, such as 8 mm.

After dispensing of the mix onto the temporary support, the mix is covered with a top sheet or cover and undergoes a following step where the press ram applies a predetermined pressure value on the free surface and is at the same time subjected to vibration at predetermined frequencies.

Then the article, after removal of the cover and extraction from the support, is allowed to harden, this step varying depending on the type of binder which is used.

The method is per se well-known to the person skilled in the art under the name of BRETONSTONE and therefore will not be described further.

The mix is dispensed onto the temporary support by means of a dispenser, whereby the dispenser and temporary support perform a relative movement such that the mix, which by nature is normally viscous and sticky and has a consistency very similar to that of wet sand, may be discharged by means of gravity so as to fill the support. The support may be a simple sheet of paper or other material, or a tray mould for example made of rubber with reinforcing plies.

In the description below reference will be made only to dispensers and associated plants for the production of slabs, it being understood that the principles of the present invention may be applied equally well also to a dispenser and an associated plant for the production of blocks, as will become clear from the continuation of the description.

The weight-controlled dispensers comprise a hopper with a top opening via which the mix is introduced and a bottom opening. A conveyor comprising essentially an extractor belt wound around a drive roller and an idle roller is provided opposite the bottom opening. The extractor belt, which is normally inclined downwards and moved by means of the drive roller, allows the mix to be transported from the bottom opening of the hopper to the discharging end of the conveyor belt.

A weight-controlled dispenser of this type is described for example in Italian patent IT 1335533.

In this type of dispenser, the hopper is filled beforehand with a quantity of mix, calculated in terms of weight, necessary for forming a slab of material. The weight is monitored by means of load cells which are positioned on the dispenser and which are able to detect the weight of the mix introduced into the dispenser.

Once the hopper has been filled, the weight-controlled dispenser is moved along the forming line so as to pour the mix onto the temporary support which is kept immobile. These dispensers are called moving weight-controlled dispensers. There also exist other types of dispensers of the fixed type, described below, where it is the support which is moved to receive the discharged mix, the mix being normally fed continuously during filling of the temporary support.

Italian patent IT1350700 describes a weight-controlled dispenser in which an internal wall of the hopper is shaped as to convey more efficiently the material towards the outlet. The internal wall, on the front part of the dispenser facing the discharge end of the conveyor, has a convexity directed towards the inside of the hopper.

Owing to the stickiness of the aforementioned mix, the latter has the tendency to form incrustations on the shaped wall and on the discharge opening of the hopper, said incrustations interfering with dispensing of the mix and, owing to modification of the dimensions of the cross-section of the layer of mix discharged onto the extractor belt, creating the risk of non-uniform dispensing of the mix.

For this reason, the shaped wall is lined with a sheet of non-adhesive material, for example PTFE (polyethylene terephthalate). The sheet, which is changed at suitable intervals, has the function of keeping the wall clean and avoiding the need for frequent stoppages of the production plant in order to clean the wall.

In these dispensers, the sheet is unwound from a roll located upstream of the shaped wall and wound around a second roll located downstream of the shaped wall. Periodically, the sheet of non-adhesive material is slid over the wall and wound onto the second roll, thus resulting in instantaneous cleaning of the wall.

The extractor belt is also lined with a protective film of plastic material, for example polyethylene, so as to keep it clean and avoid incrustations of mix.

Both the non-adhesive sheet of the shaped wall and the protective film of the extractor belt are spread out with the aid of an idle feed roller containing the sheet or the film and a motor-driven take-up roller.

Both the non-adhesive sheet and the plastic film must also be resistant to solvent vapours, in particular the styrene vapours which are present in the mix in which a polyester resin is used.

As already mentioned, there is also a second type of dispenser called a static weight-controlled dispenser.

In these dispensers the dispenser remains immobile and it is instead the temporary support which is moved along the forming line; for this purpose a shuttle is positioned underneath the extractor belt in order to support the temporary support.

The shuttle moves at a controlled speed correlated to that of the extractor belt.

Load cells are provided on the weight-controlled dispenser in order to control and measure the weight of the mix; moreover the shuttle is also provided with load cells for detecting the weight of the support filled with mix and therefore the mix itself. In these dispensers normally the mix is continuously fed into the hopper during filling of the temporary support, so that there is always a reasonable amount of mix inside the hopper in order to favour highly uniform extraction of the mix from the conveyor opening.

Italian patent IT 1380651 describes a mix dispenser provided with a dye dispenser having nozzles which spray liquid dye onto the mix deposited on the extractor belt, in the vicinity of the discharge end, i.e. just before the mix falls from the extractor belt and fills the underlying mould.

Italian patent IT 1393465 describes a weight-controlled dispenser comprising a dye dispenser with controlled valves, a rotating diffuser with perforated plates for dispensing more uniformly the mix which falls onto the temporary support and a crushing roll for crushing the lumps of mix.

The mix dispensers of the prior art, although they are widely used and established, have a number of drawbacks.

Firstly, the extractor belt onto which the mix discharged from the hopper is deposited and which is made of fabric-reinforced elastomeric material, has a relatively high cost.

Moreover, during the manufacture of slabs using polyester resin binders, the conveyor belt, which is normally made of PVC or polyurethane, even if lined with the protective film, owing to the atmosphere charged with solvent vapours, in particular styrene vapours, is very prone to attack by these vapours which cause the rapid and premature deterioration thereof.

Consequently the working life of the conveyor belt is on average very short, so that maintenance thereof is costly.

This usually involves the replacement of the belt, thus also resulting in fairly lengthy stoppage of the production plant with a consequent increase in the production costs.

The object of the invention is therefore to solve at least partially the drawbacks of the prior art.

A first task of the present invention is to provide a dispenser for mixes which is not affected by the problems associated with the use of an extractor belt made of reinforced elastomeric material.

A second task is that of reducing the operating cost of the plant by reducing the costs associated with maintenance of the extractor belt.

A further task of the present invention is to provide a dispenser where the plant stoppage time necessary for maintenance is limited.

The object and tasks are achieved with a mix dispenser according to Claim 1 and a plant for the production of slabs of stone or stone-like material according to Claim 14.

The invention is characterized in that the extractor belt made of ply-reinforced plastic material is replaced by a meshwork conveyor which is resistant to solvents such as styrene, preferably made of metal, said meshwork being still lined with the same thin protective film of plastic resistant to solvent vapours.

The advantages and characteristic features of the present invention will emerge more clearly from the detailed description below of a number of examples of embodiment provided by way of a non-limiting example, with reference to the attached drawings in which.

Figure 1:
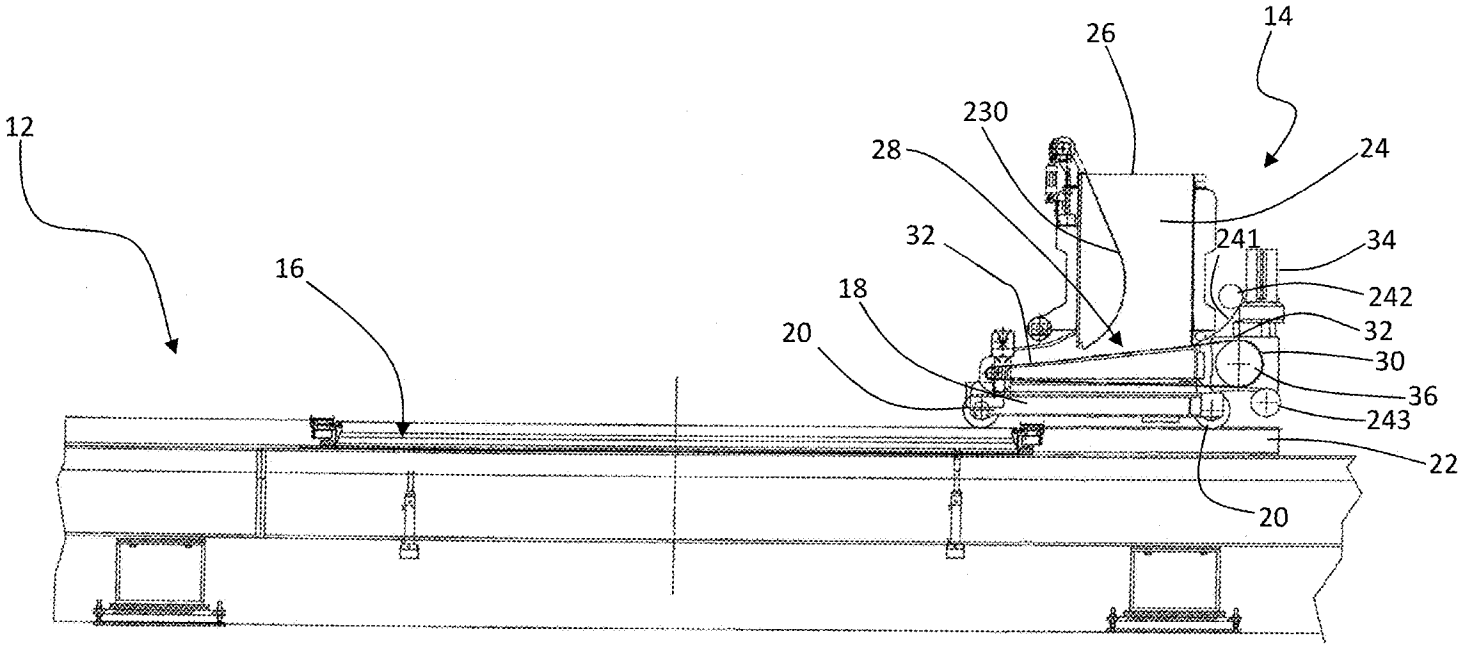
FIG. 1 shows a schematic side view of a plant according to the present invention.

In FIG. 1 the reference number 12 denotes a plant for the production of slabs consisting of stone or stone-like material and an organic or inorganic binder.

The plant 12 comprises a mix dispenser 14, a mould or temporary support 16 and means for relative movement of mix dispenser 14 and support 16.

In accordance with a possible embodiment of the present invention, the relative movement means may comprise a carriage 18 which is operated by a motor (not shown) and provided with wheels 20 (two for each of the two sides) which travel on respective rails 22. The motor may be of the variable-speed type for adjusting the quantity of material dispensed, as will become clear from the continuation of the description.

Figure 2:
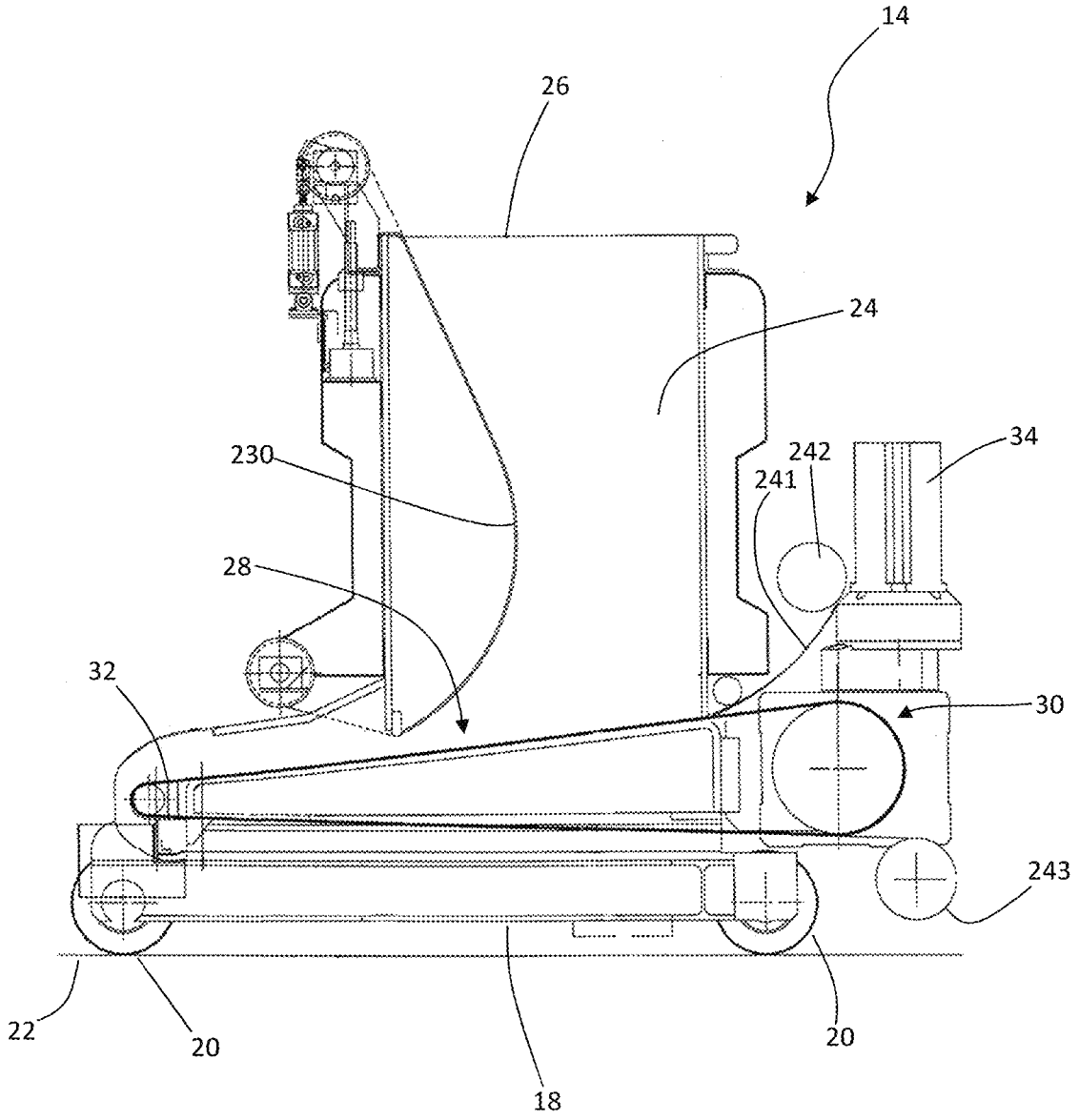
FIG. 2 shows a schematic side view of a dispenser according to the present invention.

The mix dispenser 14, as can be seen in FIG. 2, comprises a hopper 24 provided with a top opening 26 and a bottom opening 28.

The top opening 26 is used to fill the hopper with a predetermined amount of mix in a manner known per se to the person skilled in the art.

The hopper 24 may be provided with a shaped wall 230, of the type described further above with reference to the relevant prior art.

The mix dispenser 14 also comprises a conveyor 30.

The conveyor 30 comprises a, preferably metallic, solvent-resistant supporting meshwork 32 which is operated by an electric motor 34.

The supporting meshwork 32 forms the bottom of the hopper 24. The supporting meshwork may be inclined forwards with an inclination of between 5° and 15°, and preferably about 10° relative to the horizontal.

The meshwork used may be for example the metal meshwork commercially distributed by COSTACURTA under the trade name VICO-TR®.

The aforementioned metal meshwork is made using small metal strips (long flat elements). These long flat elements are folded onto themselves to form an element with a substantially undulating progression. These elements are then fixed in pairs by means of pins, perpendicularly relative to the direction of folding, and in the vicinity thereof, so that their relative rotation along the axis of the pins is possible.

This type of conveyor, since it is well-known to the person skilled in the art, will not be described further.

Figure 3:
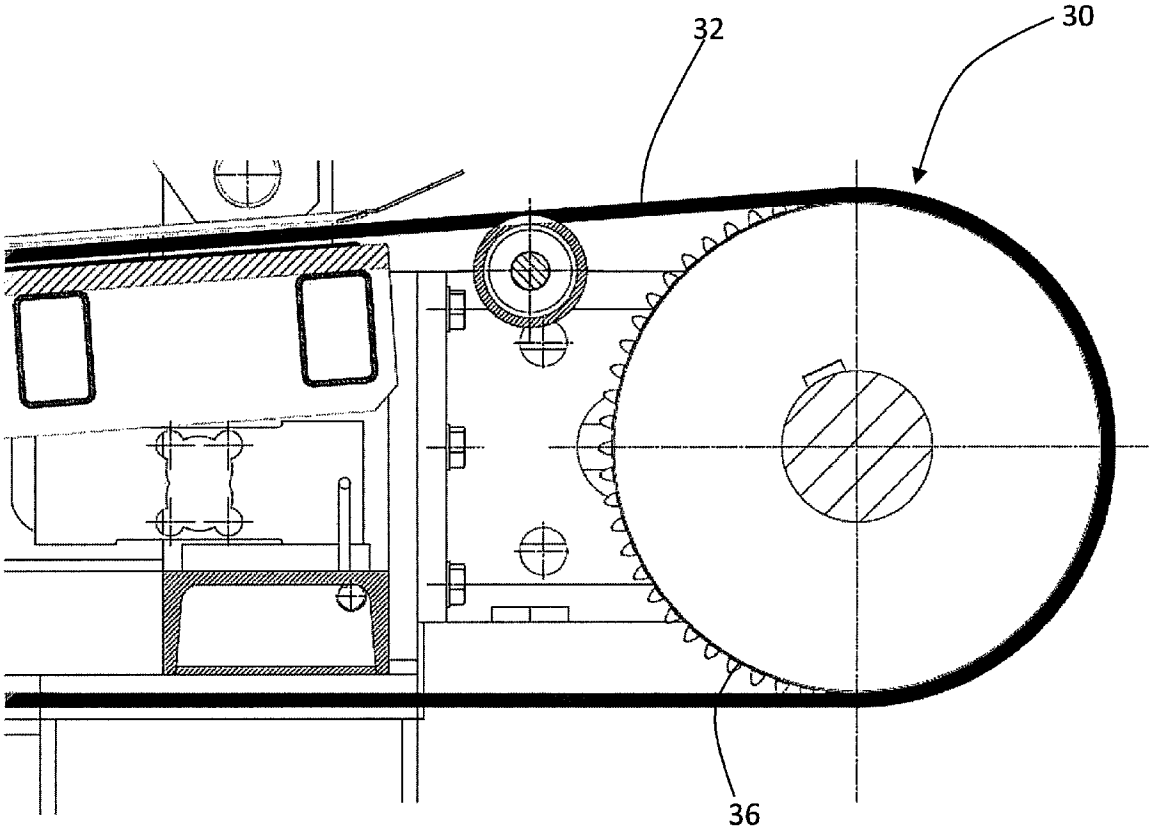
FIG. 3 shows a schematic side view of a portion of the dispenser according to FIG. 2.
Figures 4, 5:
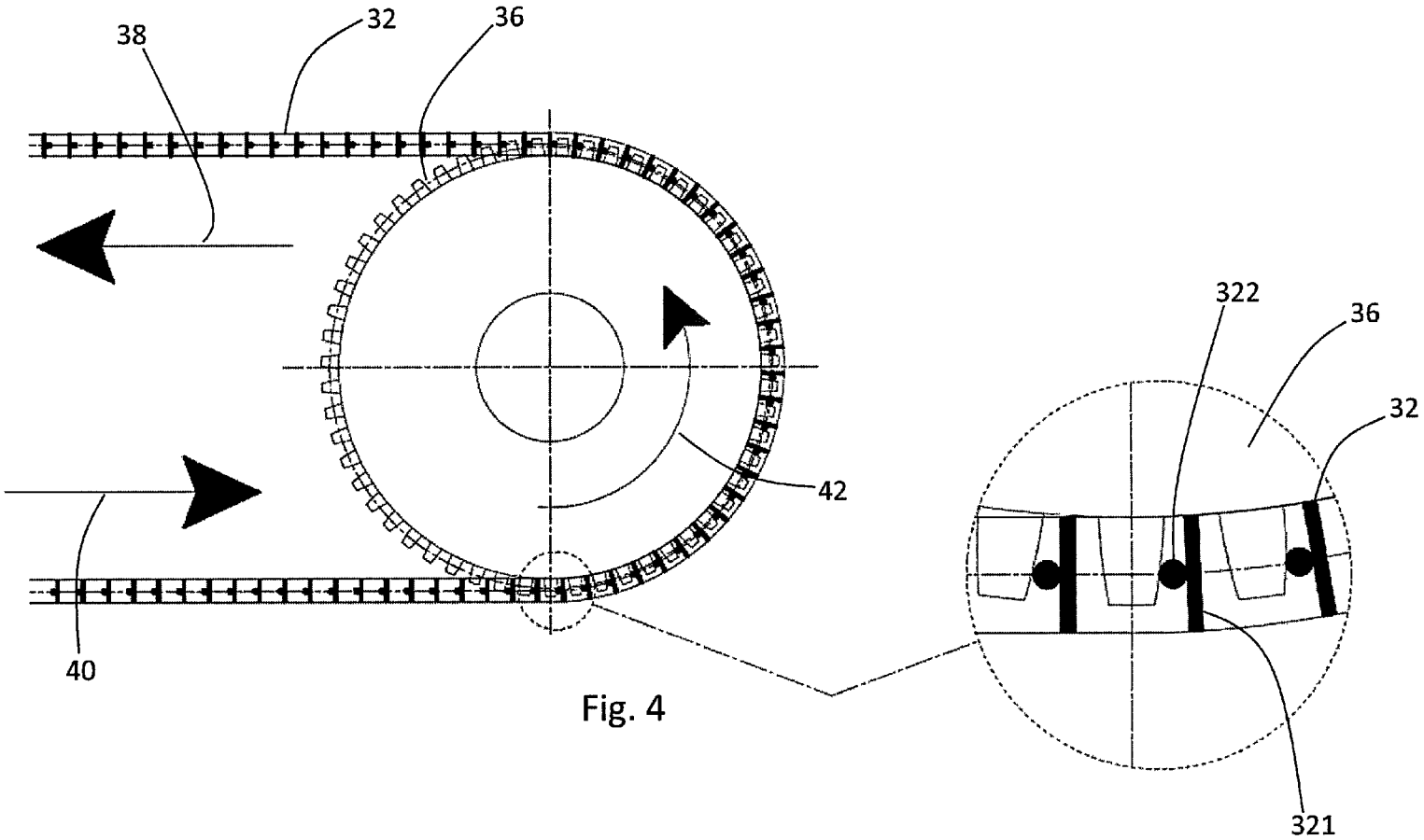
FIG. 4 illustrates an example of operation of a portion of a dispenser according to the present invention.
FIG. 5 shows a view, on larger scale, of a detail of FIG. 4.

As can be seen from FIGS. 3, 4 and 5, the conveyor 30 also comprises cog wheels 36 for driving the meshwork. In accordance with the embodiment shown in FIG. 6, the conveyor 30 may comprise a plurality of cog wheels 36 which are equidistant from each other. The cog wheels 36 are keyed onto the same shaft and rotated by means of the electric motor 34.

Figure 6:
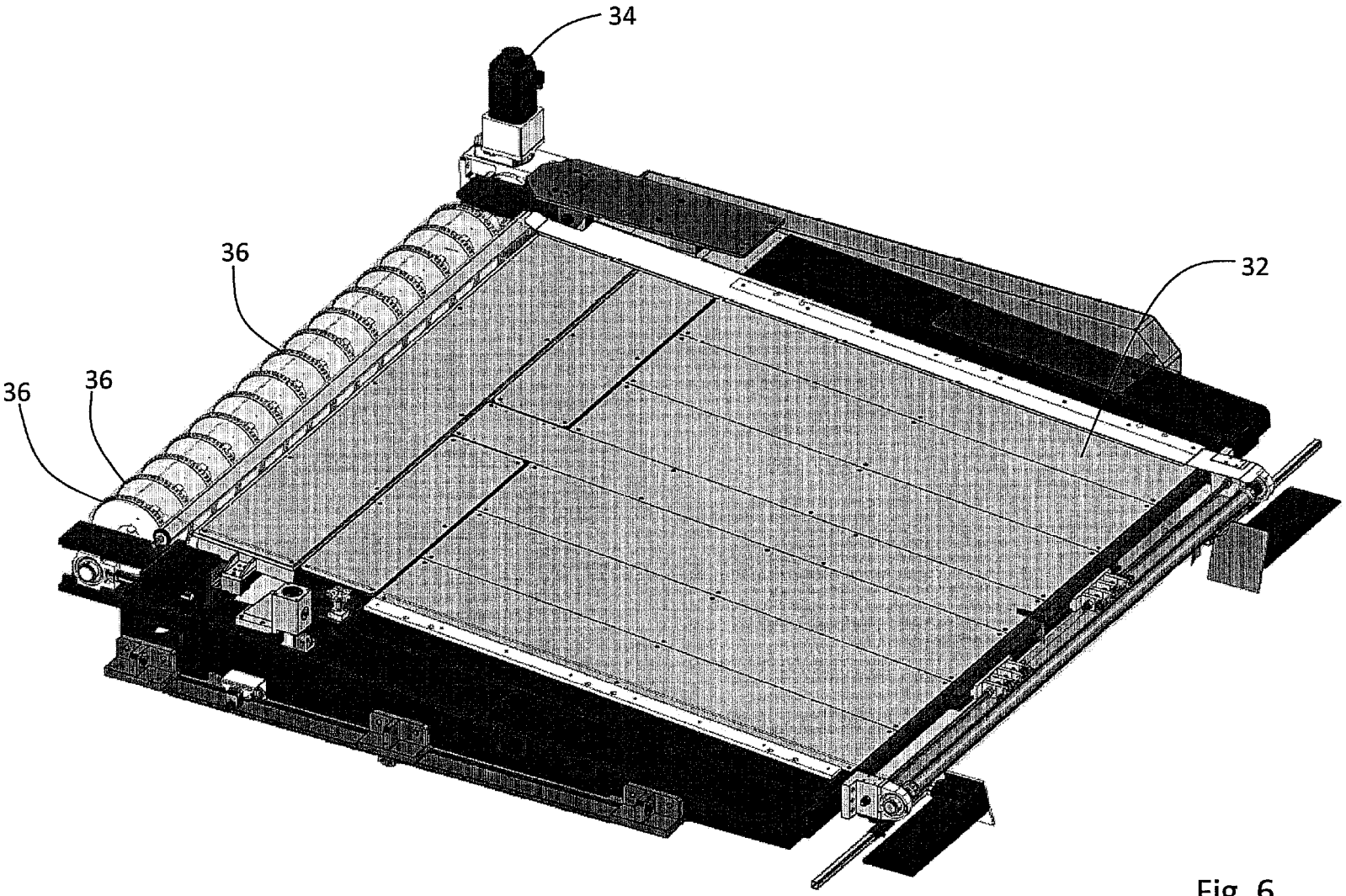
FIG. 6 shows a schematic perspective view of a portion of a dispenser according to the present invention.

In the embodiment shown in FIG. 6, the cog wheels 36 are fifteen in number and equidistant from each other.

Moreover a series of idle wheels is provided at the opposite end.

The cog wheels 36, which engage directly inside the meshes of the meshwork, ensure a highly uniform advancing movement of the material. FIGS. 3 and 4 and the detail of FIG. 5 illustrate in schematic form how transmission between cog wheel and mesh of the meshwork is performed. From the figures it can also be seen that the return section of the meshwork is pulled by the cog wheels, while the outgoing section, on which the material is supported, is pushed by the cog wheels. The direction of movement is indicated by the arrows 38, 40, 42.

The supporting meshwork 32 is lined with a plastic film 241 such that the mix which is discharged from the hopper 24 is deposited on the plastic film 241. In fact, if the film for supporting the mix were not present, the mix would fall through the meshes of the metal meshwork.

Advantageously, the plastic film 241 may be of the type mentioned with reference to the protective film of the preceding extractor belt.

The plastic film may be made for example of polypropylene or polyethylene.

The size of the meshes is such as to support the mix by means of the plastic film and is of the order of about 10 mm or so. Advantageously, the size of the meshes ranges between 8 and 12 mm.

As can be seen in FIG. 2, the dispenser 14 comprises a feed roller 242 for the plastic film and a recovery roller 243. Advantageously, the feed roller 242 may be positioned above the conveyor, while the recovery roller 243 may be positioned below the conveyor 30.

The advantages which can be achieved with a mix dispenser equipped with a meshwork conveyor are therefore evident.

Firstly, with a meshwork conveyor there is large amount of free area and therefore the conveyor may be easily cleaned.

Moreover, the meshing action between cog wheels and meshes of the meshwork ensures a high degree of operational reliability. In fact, since it is moved by cog wheels (which are also low-cost and reliable), the meshwork remains perfectly centred and also ensures feeding at a controlled speed without the risk of slipping.

It has also been noted that the thin protective film adapts itself to the mesh surface of the meshwork, forming inside each mesh a kind of small tray inside which the mix is arranged. This feature is very important for the production process of the plant since it facilitates greatly regular extraction of the mix (which is normally very viscous), in a continuous manner, from the hopper. Moreover, it thus ensures regular and uniform falling of the mix on top of the tray.

A further advantage consists in the metallic nature of the meshes, which ensures flexibility of use independently of the process temperature.

Moreover, the meshwork conveyor, which is preferably metallic, not only has a lower cost compared to a conventional conveyor belt, but in particular is both mechanically stronger and more resistant to the styrene vapours. As already mentioned, although the protective film is present, owing to the atmosphere charged with styrene vapours, the conveyor is in any case subject to attack by the vapours, but, because of its strong, preferably metallic, structure, it is not affected by said vapours.

The conveyor therefore requires a small number of replacement operations with consequent savings both in terms of cost of the belt itself, but also in particular because the maintenance time and therefore the production downtime is reduced, with obvious advantages from an economic point of view.

The person skilled in the art, in order to satisfy specific requirements, may make modifications to the embodiments described above and/or replace the parts described with equivalent parts, without thereby departing from the scope of the accompanying claims.

For example, the meshwork may also not be metallic and be made of a plastic material. In this case, the advantage arising from the greater mechanical strength of the metal meshwork would be forfeited, but the additional advantage of a greater lightness of said meshwork would be gained. Moreover, the meshwork itself would be manufactured more easily and at a lower cost.

As already mentioned above, although this solution has been developed for Bretonstone resin, it could be applied also to similar technologies, such as those which use cementitious binders (Bretonstone), or to Lapitec technology.

The invention claimed is:

1. A mix dispenser comprising a hopper with a top opening for filling the hopper with a predetermined amount of mix and a bottom opening, said dispenser further comprising a conveyor which forms a bottom of said hopper and is configured to extract the mix from the hopper and convey the mix towards an end from where the mix falls into a mould;

characterized in that said conveyor comprises a supporting meshwork operated by an electric motor, said supporting meshwork being lined with a plastic film; and wherein the plastic film is adaptive to the meshwork so as to form, inside meshes of the meshwork, corresponding trays in which the mix is arranged.

2. The mix dispenser according to claim 1, characterized in that said supporting meshwork is made of a material resistant to vapours of solvents.

3. The mix dispenser according to claim 2, characterized in that said supporting meshwork is made of metal.

4. The mix dispenser according to claim 3, characterized in that the metal supporting meshwork is formed with flat strips folded onto themselves to form elements with a substantially undulating progression, said elements being fixed in pairs by means of pins, perpendicularly oriented relative to a direction of folding, and in a vicinity of the element pairs so that relative rotation of the element pairs along axes of the pins is possible.

5. The mix dispenser according to claim 2, characterized in that said supporting meshwork is made of a material resistant to vapours of styrene which are present in the mix in which a polyester resin is used.

6. The mix dispenser according to claim 1, characterized in that the supporting meshwork is inclined forward with an inclination of between 5° and 15° relative to horizontal.

7. The mix dispenser according to claim 1, characterized in that the conveyor further comprises at least one cog wheel for driving the supporting meshwork.

8. The mix dispenser according to claim 7, characterized in that the at least one cog wheel is keyed onto a shaft and is rotated by means of the electric motor.

9. The mix dispenser according to claim 7, characterized in that the conveyor comprises a plurality of cog wheels which are equidistant from each other.

10. The mix dispenser according to claim 7, characterized in that said conveyor comprises a series of idle wheels at an end opposite to the at least one cog wheel that is rotated by means of the electric motor.

11. The mix dispenser according to claim 1, characterized in that a supporting surface onto which the mix discharged from the hopper is poured comprises the plastic film placed on said supporting meshwork so as to in turn line said supporting meshwork.

12. The mix dispenser according to claim 11, characterized in that the plastic film is made of polypropylene or polyethylene.

13. The mix dispenser according to claim 11, characterized in further comprising a feed roller for the plastic film and a recovery roller.

14. The mix dispenser according to claim 1, characterized in that the meshwork so as to support the mix is formed of plastic film.

15. The mix dispenser according to claim 14, characterized in that a size of the meshwork is 10 mm.

16. The mix dispenser according to claim 1, characterized in that a size of the meshwork so as to support the mix ranges between 8 and 12 mm.

17. A plant for production of slabs from stone or stone-like material and a binder, comprising a mix dispenser according to claim 1.

* * * * *